United States Patent [19]

Salomon

[11] 4,350,364

[45] Sep. 21, 1982

[54] SKI BRAKE

[75] Inventor: Georges P. J. Salomon, Annecy, France

[73] Assignee: Ets Francois Salomon & Fils, Annecy, France

[21] Appl. No.: 131,376

[22] Filed: Mar. 18, 1980

[30] Foreign Application Priority Data

Mar. 19, 1979 [FR] France ..... 79 07702

[51] Int. Cl.[3] ..... A63C 7/10

[52] U.S. Cl. ..... 280/605; 188/5

[58] Field of Search ..... 280/604, 605; 188/5, 188/6, 8

[56] References Cited

U.S. PATENT DOCUMENTS

| | | | |
|---|---|---|---|
| 4,036,509 | 7/1977 | Schwarz | 280/605 |
| 4,128,256 | 12/1978 | Weigl | 280/605 |
| 4,188,043 | 2/1980 | Schwarz | 280/605 |
| 4,245,851 | 1/1981 | Krob | 280/605 |
| 4,279,434 | 7/1981 | Riedel | 280/605 |

FOREIGN PATENT DOCUMENTS

| | | | |
|---|---|---|---|
| 2632849 | 1/1978 | Fed. Rep. of Germany | 280/605 |
| 2635151 | 2/1978 | Fed. Rep. of Germany | 280/605 |

*Primary Examiner*—Joseph F. Peters, Jr.
*Assistant Examiner*—Donald W. Underwood
*Attorney, Agent, or Firm*—Karl F. Ross

[57] ABSTRACT

A ski brake has a support securable to the upper surface of a ski and forming a longitudinal passage extending in the normal ski displacement direction. A brake element is pivotal on this support about an element axis between a skiing position generally parallel to the ski and wholly above the lower ski surface and a braking position extending downwardly past and transverse to this lower surface. A wire biasing loop is connected between the brake element and the support and urges the element into the braking position. This loop has a pivot section pivoted in the support at a pivot axis perpendicular to the ski displacement direction and parallel to the ski upper surface and a leg extending through the passage and longitudinally displaceable therein between a forwardly advanced position corresponding to the braking position of the element and a rearwardly retracted position corresponding to the element skiing position. The loop is relatively greatly elastically deformed and lies generally flatly on the ski in the skiing position and is less elastically deformed and stands up in the braking position.

25 Claims, 18 Drawing Figures

FIG.3
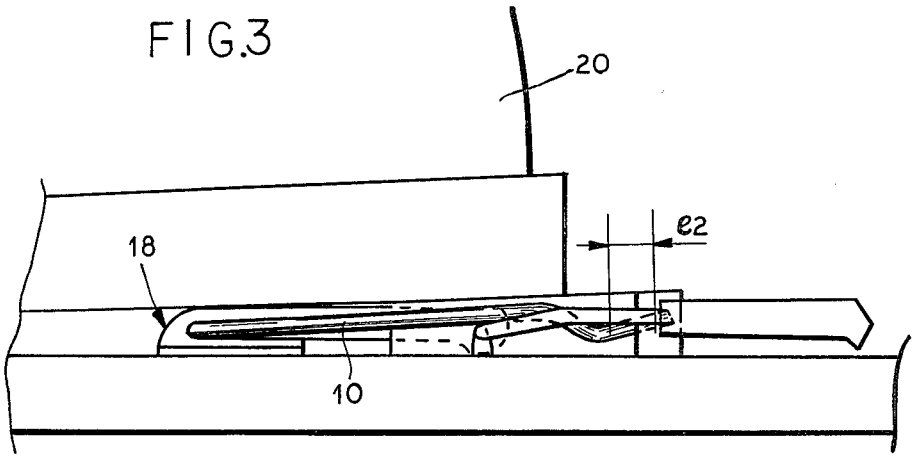
FIG.4
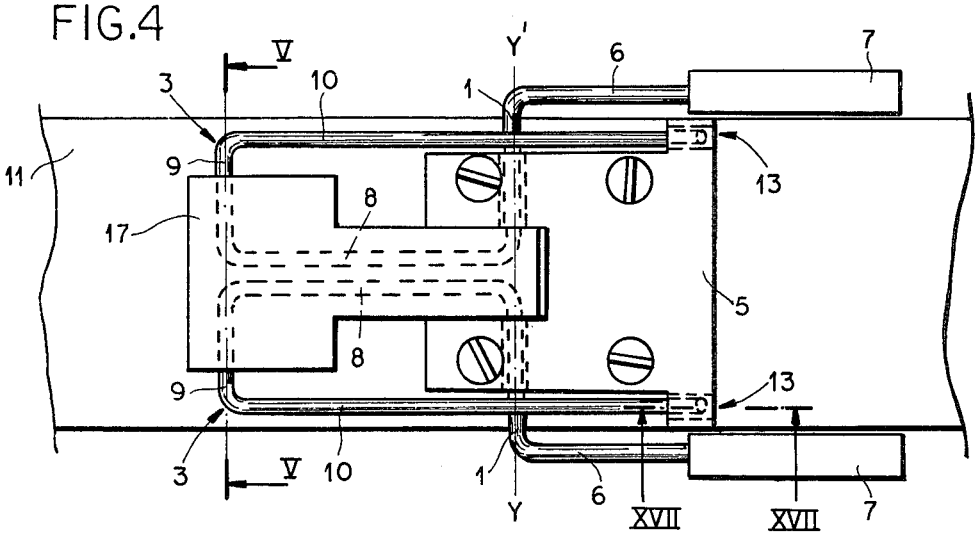
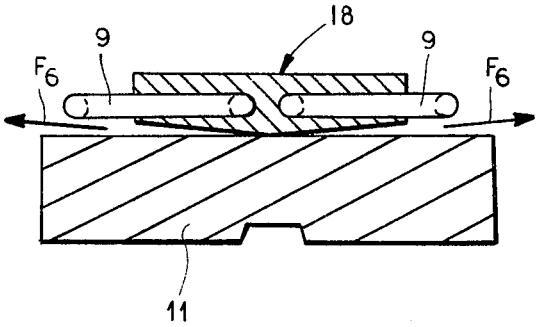
FIG.5
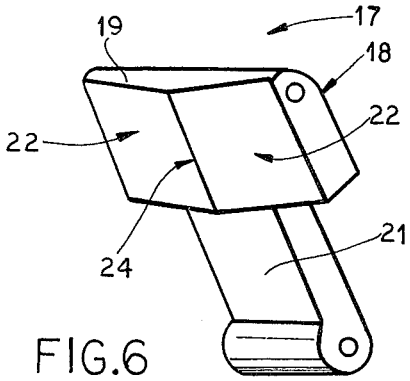
FIG.6

FIG.14
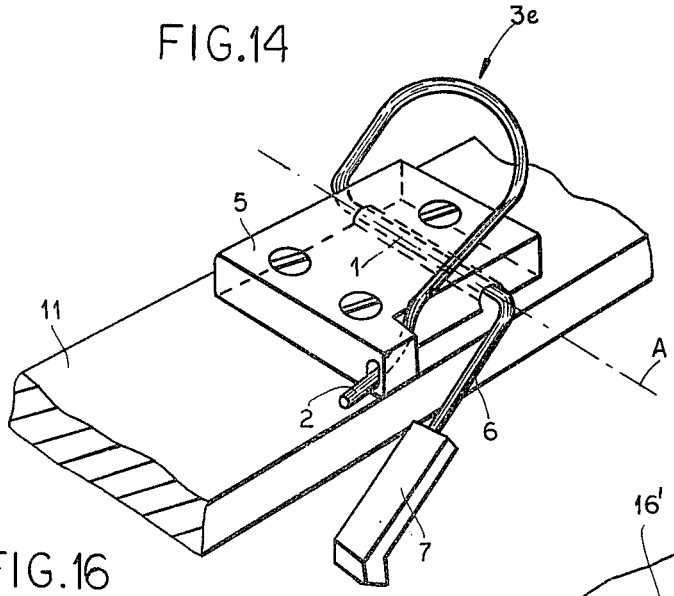
FIG.15
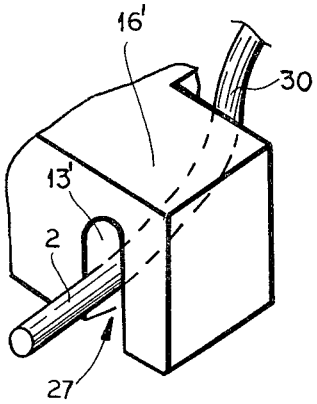
FIG.16
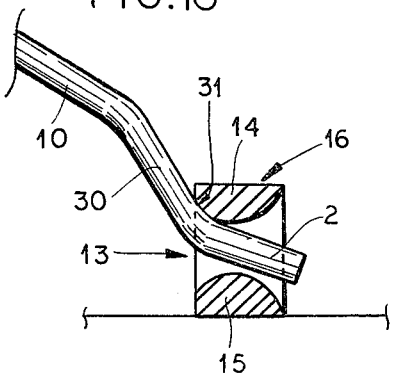
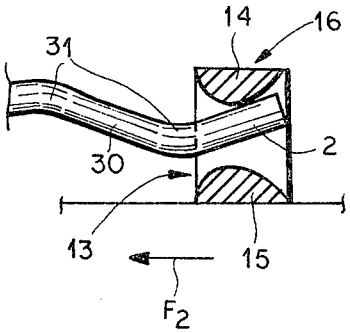
FIG.17
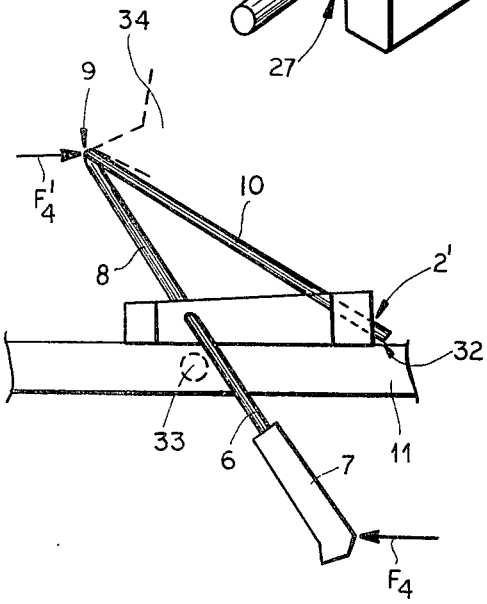
FIG.18

SKI BRAKE

FIELD OF THE INVENTION

The present invention relates to a ski brake. More particularly this invention concerns a device carried on a snow ski that serves to automatically stop the ski should it become detached from the skier's boot.

BACKGROUND OF THE INVENTION

Ski brakes can be seen in commonly owned U.S. Pat. Nos. 4,188,043 and 4,036,509 and in the references of other applications that are cited therein, as well as from copending and commonly owned application Ser. No. 072,626 filed Sept. 5, 1979 (now U.S. Pat. No. 4,279,434) and in the references and other applications cited therein.

A typical ski brake has a support that is secured to the ski and constitutes part of the ski binding, and a brake element that is pivotal on the support about a brake-element axis between a skiing or rest position generally parallel to the ski and lying wholly above the lower surface thereof and a braking position extending downwardly past and transverse to the lower surface of the ski. Means is provided, normally in the form of some kind of spring arrangement, that biases the brake element into the braking position, and that is loaded when the ski boot is properly secured to the ski to automatically move the brake element into the skiing or rest position. When the ski boot becomes disconnected this biasing means automatically pivots the brake element into the braking position so that it will dig into the snow underneath the ski and prevent it from running away. Such a device can therefore effectively prevent a ski that becomes accidentally detached from the skier from sliding at high speed down the slope. As such a runaway ski is a serious safety problem on a crowded ski slope many ski slope rules request all skiers to have such ski brakes, as serious injuries have resulted from runaway skis.

Although many versions of ski brakes exist on the market, the item can nonetheless be substantially improved on. The conditions under which ski brakes are used—snow and ice—militate against reliable operation of any complex mechanism. It is essential that the mechanism functions even under these adverse conditions.

Another problem with the known ski brakes is that the mechanism is not very robust, so that it is possible for the braking element to be bent back from the braking position, thereby becoming ineffective. This can occur if the skier's boot becomes detached from the ski while moving at high speed, as the various parts of the ski-brake mechanism are normally not robust enough to absorb substantial shock.

OBJECTS OF THE INVENTION

It is accordingly an object of the present invention to provide an improved ski brake.

Another object is the provision of a ski brake which can withstand substantial shock.

Yet another object is to provide a ski brake which is characterized by extremely simple construction but which nonetheless is extremely robust and at the same time of dependable long-life sevice.

SUMMARY OF THE INVENTION

These objects are attained according to the instant invention in a ski brake of the above-described general type wherein the biasing means is a wire biasing loop connected between the brake element and the support and urging the element into the braking position. This loop has a pivot section pivoted on a support for pivoting about a loop pivot axis generally parallel to the ski surfaces and perpendicular to the normal displacement direction of the ski and another leg extending through a longitudinal passage extending in the normal direction of displacement of the ski and longitudinally displaceable therein between a forwardly advanced position corresponding to the braking position of the element and a rearwardly retracted position corresponding to the skiing position. This loop is relatively greatly elastically deformed and lies generally in a plane parallel to the ski surfaces in the skiing position and is less elastically deformed and stands up from the upper surface of the ski in the braking position of the element.

According to further features of this invention the passage lies ahead relative to the displacement direction of the pivot axis for the pivot section of the loop. The inherent result of this type of structure is that the leg which will lie parallel to the ski during the skiing position will be inclined forwardly downwardly when in the braking position. A force applied backwardly on the braking element will therefore be transmitted to this leg in a direction pushing it forwardly downwardly toward the ski. The result will be a locking together of various parts of the ski brake so that the system will be able to absorb considerable forces, with these force being taken up elastically over the entire wire structure constituting the loop and the leg.

This last-mentioned feature can be made even more effective by forming the leg with an elbow that is open upwardly and that cradles the upper side of the passage when the ski brake is in the braking position. Thus the structure effectively finds a solid end position for the brake element, whose force will be spread out through the entire wire structure of the biasing arrangement and leg. In this manner even if the ski becomes disattached from the skier's boot while moving at high speed, the brake element will be capable of withstanding the enormous forces necessary to stop the ski without damage to itself or its associated mechanism.

According to further features of this invention the wire is of spring steel. It either can be formed as a continuous generally uniform loop or as a sequence of generally straight sections, normally perpendicular to each other. The passage has an upper side that limits displacement of the leg away from the ski and may be formed downwardly convex. The entire passage may be flared in both directions, or the underside of the massage may be formed by the upper surface of the ski.

According to further features of this invention the loop has an end section which extends generally perpendicular to the pivot section and constitutes the brake element. This brake element itself is a synthetic-resin bar molded on and covering the end section.

A pedal in accordance with another feature of this invention is pivoted on the support and connected to the bight that connects the pivot section and the leg of the loop. This pedal stands up from the upper surface of the ski in the braking position and lies generally flatly on the upper surface in the skiing position. The pivot end is pivoted on the support and the other end is connected to the bight. This other end has an upwardly curved and convex end region that is engageable with the ski boot that operates the brake element. The pivoted end of the pedal can lie relative to the normal displacement direction of the ski either ahead of or behind the other end of the pedal. It is also possible for the brake element to be fixed on and generally parallel to this pedal. According to the invention the pedal has an underside turned toward the ski and lying thereon in the skiing position. This underside is generally of V-shape and has a central ridge engaging the upper surface in the skiing position and a pair of flanking surface regions that extend upwardly from this ridge away from the upper surface. Thus if snow is on the ski as the skier is donning the ski, this snow will be pushed off to the side by these inclined flanking surfaces to allow the pedal to lie flatly on the ski.

The ski brake according to the instant invention is characterized by extreme simplicity that ensures a long and trouble-free service life of the device. It can be built at relatively low cost and can be fitted to virtually any type of ski or ski binding.

BRIEF DESCRIPTION OF THE DRAWING

FIG. 3 is a side view of the first embodiment of the ski brake in the skiing position;

FIG. 4 is a top view of the ski brake as seen in FIG. 3 with the ski boot removed for clarity of view;

FIG. 5 is a section taken along line V—V of FIG. 4;

FIG. 6 is a perspective view of a detail of the first embodiment of the ski brake according to the instant invention;

FIGS. 9, 10, 11, 12, 13 and 14 are perspective views respectively of the second, third, fourth, fifth, sixth and seventh embodiment of the instant invention;

FIG. 15 is a large-scale view of a detail of an eighth embodiment of the instant invention;

FIGS. 16 and 17 are large-scale sections taken along lines XVI—XVI and XVII—XVII of FIGS. 2 and 4, respectively; and FIG. 18 is a side view of a ninth embodiment of the ski brake according to this invention.

SPECIFIC DESCRIPTION

Figure 1:
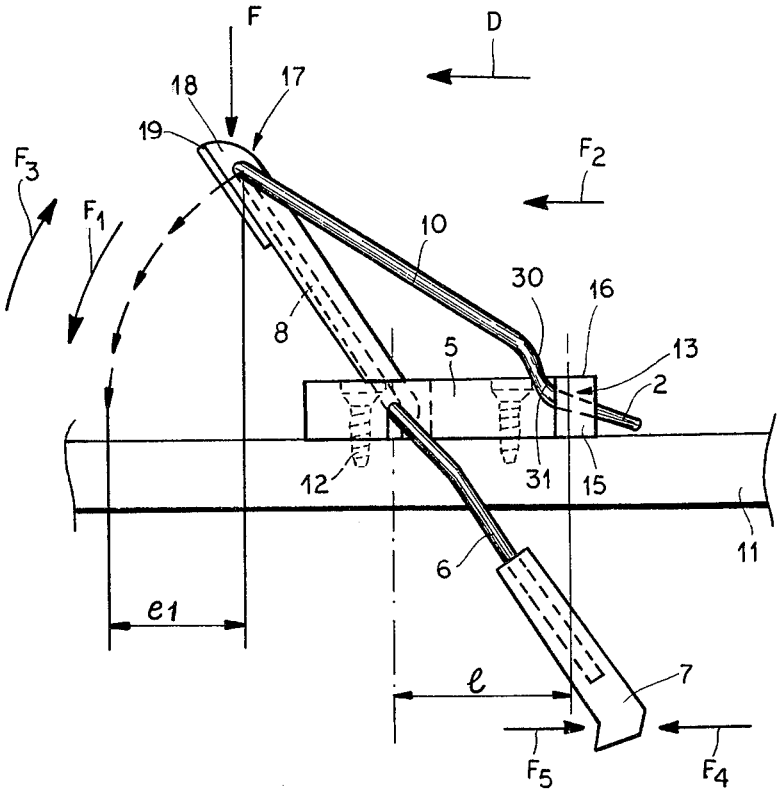
FIG. 1 is a side view of a first embodiment of a ski brake according to this invention in the braking position.

As shown in FIGS. 1–8, 16 and 17 a ski brake according to the instant invention is adapted to be mounted on a snow ski 11 that normally moves forwardly in a direction indicated at D in FIG. 1. The ski brake has a pair of spring-steel wire loops 3 each having a leg or slide section 2 and a pivot section 1. A pair of transversely throughgoing and axially aligned passages 4 in a support or mounting plate 5 define a pivot axis A for the section 1 which extends parallel to the upper and lower surfaces of the ski 11 and perpendicular to the direction D. In addition each wire loop has extending perpendicular from the respective pivot section 1 a leg or end section 6 carrying a synthetic-resin bar or body 7 constituting the brake element according to this invention.

More particularly each loop 3 has a bight formed by a succession of straight sections 8, 9 and 10. Section 8 extends from the pivot section 1 to section 9 and is normally parallel to section 1, and the section 10 has an end forming the slide section 2. In the braking position illustrated in FIGS. 1, 2 and 7 the bight formed by the various sections 8–10 stands up from the ski 11, but in the rest or skiing position of FIGS. 3–5 and 8, these sections 8–10 are all generally coplanar.

The mounting plate 5 is secured to the ski 11 by screws 12 and is generally T-shaped, having a pair of laterally outwardly extending tabs 16 each forming a longitudinally throughgoing passage 13 receiving the respective slide section 2. The wires forming the loops 3 are each formed between the respective sections 10 and respective slide sections 2 with a pair of offset elbows 31 separating a short section 30 so that the end section 2 is parallel to but offset from the respective section 10. Each passage 13, furthermore, has an upper part 14 and a lower part 15 that are convex respectively downwardly and upwardly so that the passage 13 as seen in longitudinal section as in FIGS. 16 and 17 is of hyperbolic shape, flaring in both directions. In the rest position of FIG. 17 the slide section 2 bears upwardly on the upper side 14 of the passage 13, but in the braking position as shown in FIG. 17 the outermost elbow 31 engages the correspondingly shaped surface of the upper side 14, inhibiting further forward displacement of the slide section 2.

It is also possible as shown in FIG. 15 to employ a tab 16' having a passage 13' that is downwardly open at 27 so that the lower side of the passage 13' is formed by the upper surface of the ski. As shown in FIG. 18 one can make an end section 2' that is coaxial with the respective section 10 so that a tip 32 of the section 2' engages the upper surface of the ski 11 in the braking position. This arrangement can also be set up so that in the braking position the section 9 engages forwardly against a portion 34 of the binding. What is more an abutment 33 can be provided behind the leg 6. Thus forces directed backwardly as indicated by arrow F4 in FIG. 18 will be partially absorbed by the abutment 33 and partially transmitted as forces F'4 directed forwardly so that they can be absorbed not only by the part 34 of the ski binding, but by end contact of the tip 32 on the upper surface of the ski 11.

Furthermore as shown in FIGS. 1–8, the two parts of the ski brake are jointly operated by means of a common actuating step-on plate or pedal 17 that is generally T-shaped and is molded around the sections 8 and 9. This pedal 17, as seen in FIGS. 5 and 6, has a wide end 18 and a narrow end 21, this narrow end 21 being received in a notch or cutout 23 formed in the base plate 5. Furthermore, as illustrated in FIG. 6 the underside of this pedal 18 has a central ridge 24 flanked by a pair of inclined surfaces 22 so that if there is snow on top of the ski 11 and the pedal 17 is depressed down against it this snow will be pushed aside, as indicated in FIG. 5 by arrows F6. What is more, the upper forward end of the wide portion 18 of the pedal 17 is rounded at 19 so when the ski boot 20 engages downwardly on it, it will be able to slide smoothly forwardly on the lower surface of the sole of the skiboot 20.

Figure 2:
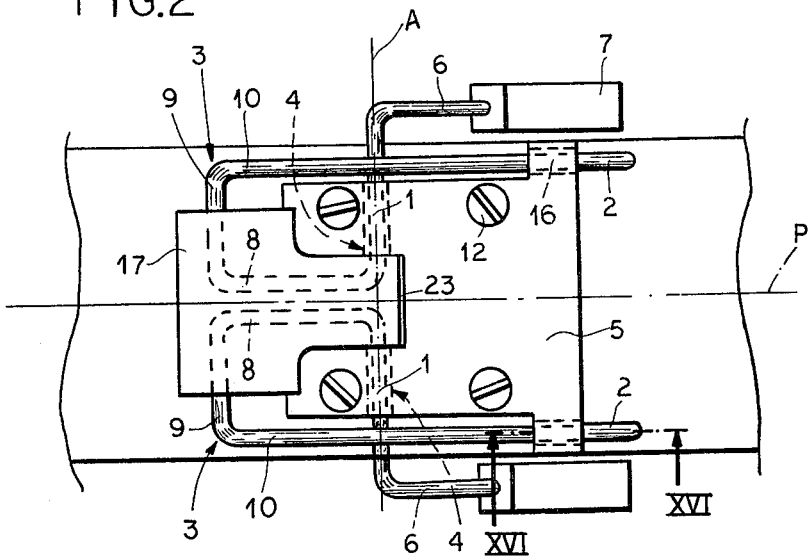
FIG. 2 is a top view of the ski brake as seen in FIG. 1.
Figure 7:
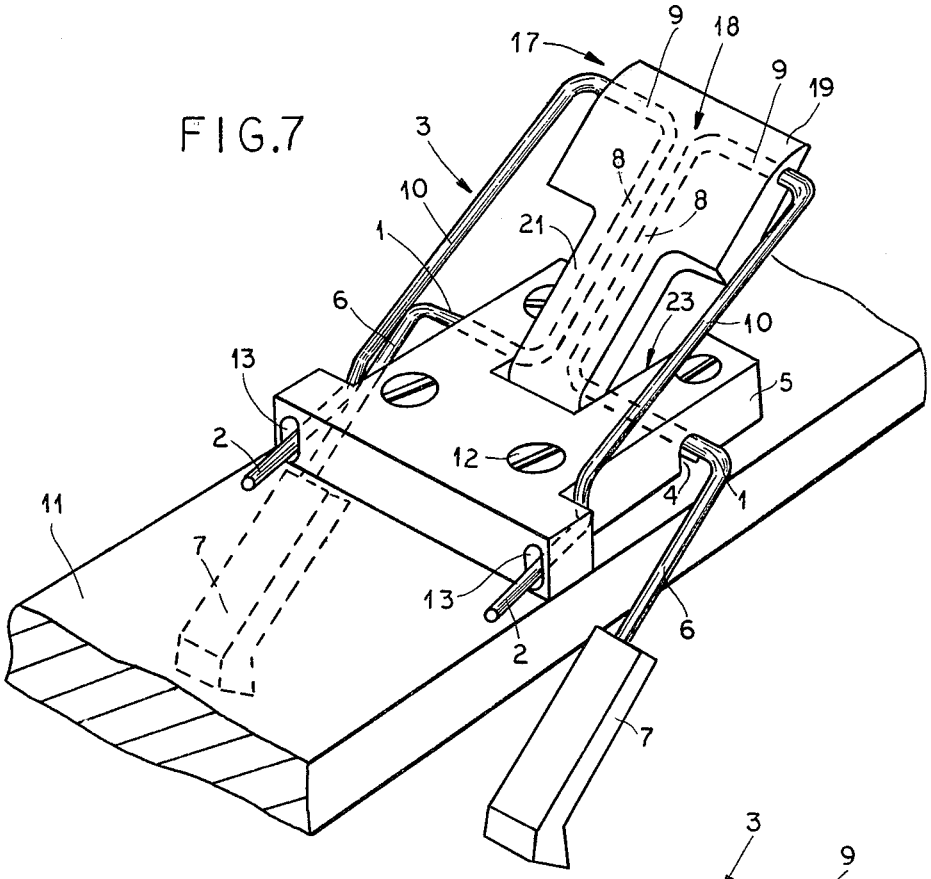
FIGS. 7 and 8 are perspective views showing the first embodiment of the ski brake respectively in the braking and skiing position.
Figure 8:
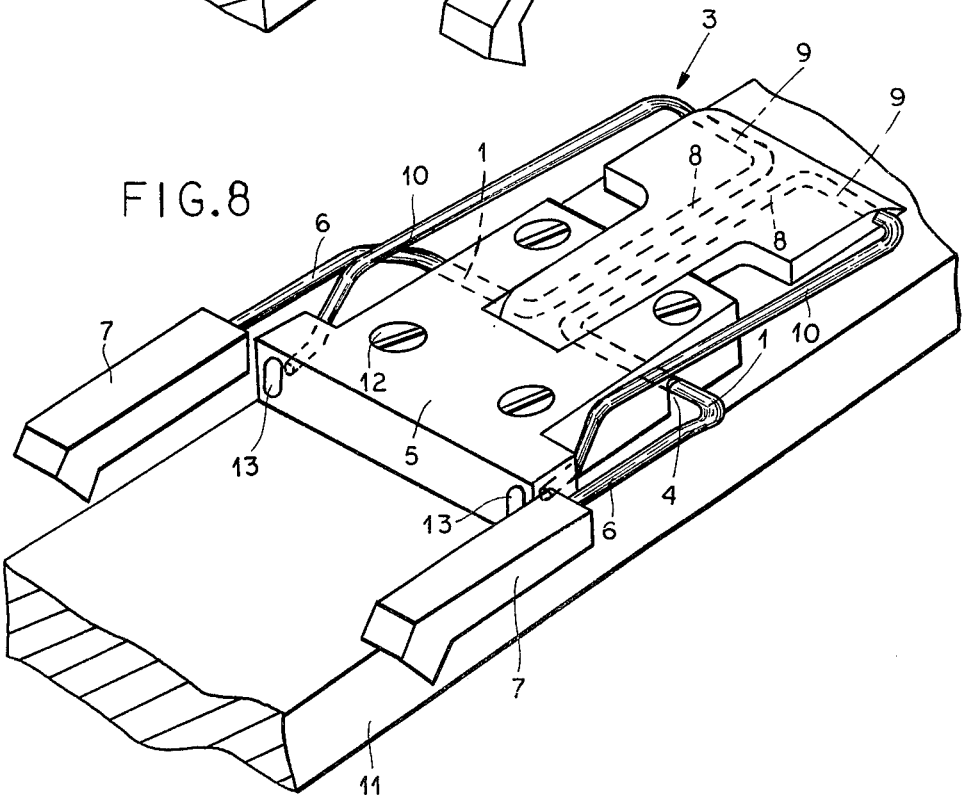

Thus the device normally stands in the position of FIGS. 1, 2 and 7. When a ski boot 20 engages downwardly in the direction F of FIG. 1 on the rounded portion 19, this action will displace the sections 9 downwardly toward the ski as shown by arrow F1 opposite the direction of arrow $F_3$ in which the biasing forces in the loops 3 urge it upwardly. This action will displace the brake element 7 forwardly and upwardly to a position above the lower surfaces of the ski as illustrated in FIGS. 3 and 4. The pivot section 1 lies ahead of the passages 13 by a distance l and the radii are such that dislacing the ski brake from the braking to the rest position moves the sections 9 backwardly through the distance el which is somewhat smaller than the distance l. The two loops 3 and brake elements 7 symmetrically flank a central plane P of the ski so that the two elements 7 will move synchronously and parallel to each other. When in the braking position as seen in FIG. 1 backwardly effectinve forces $F_4$ effective on the brake elements 7 will be countered by forces $F_5$ created by the rigidity of the mechanism, with the elbows 31 cradled in the upper portions 14 of the passages 13.

Figure 9:
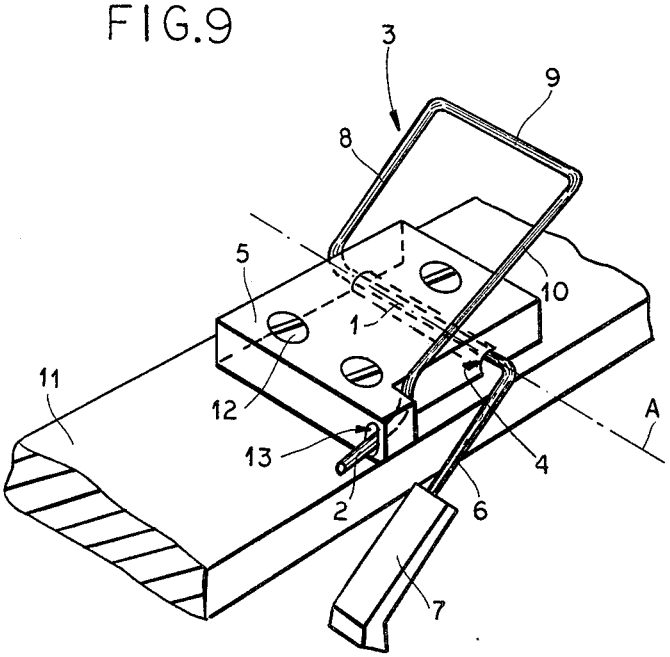

In the arrangement of FIG. 9 a single brake element 7 is provided whose loop 3 is directly actuated by the skiboot of the user. In FIG. 10 again a single brake element 7 is provided, but its section 9 passes through an elongated slot 25 in a pedal 17*a* pivoted by a pin 39 on a block 38 secured by screws 12*a* to the upper surface of the ski 11. In this arrangement the pedal has an upwardly rounded end 18*a* like the pedal 18 of FIGS. 1–8.

Figure 11:
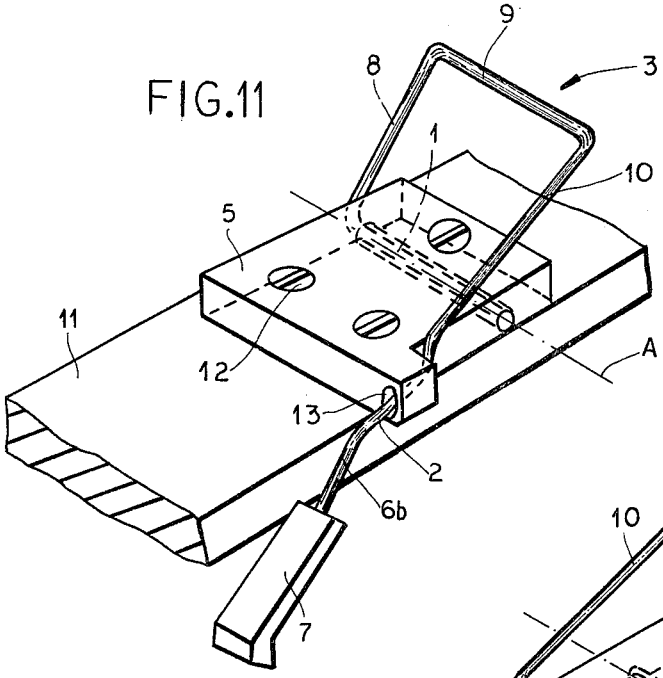
Figure 12:
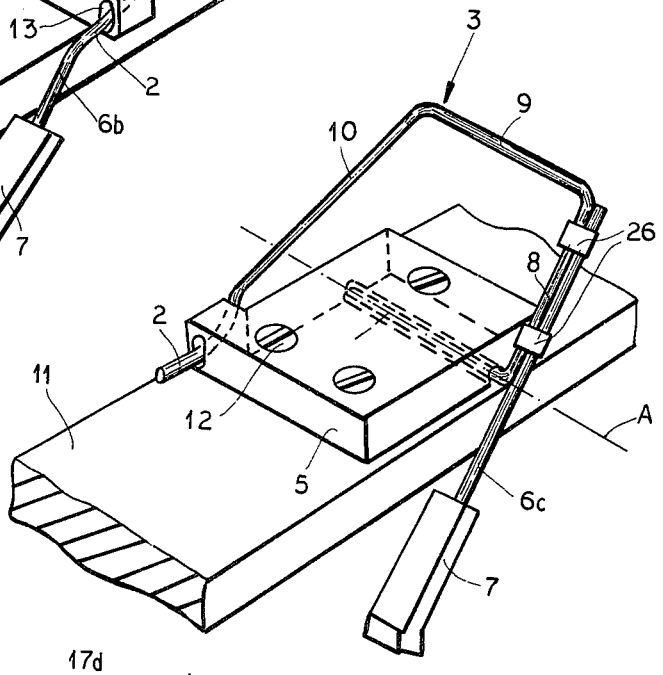

FIG. 11 shows a brake wherein the leg 2 has an extension 6*b* which carries the brake element 7, and the pivot section 6 here is an end of the loop 3. The brake element 7 is carried on a wire 6*c* connected by clips 26 to the section 8. In this arrangement, therefore the brake element 7 lies on the opposite side of the ski from the section 10.

Figure 10:
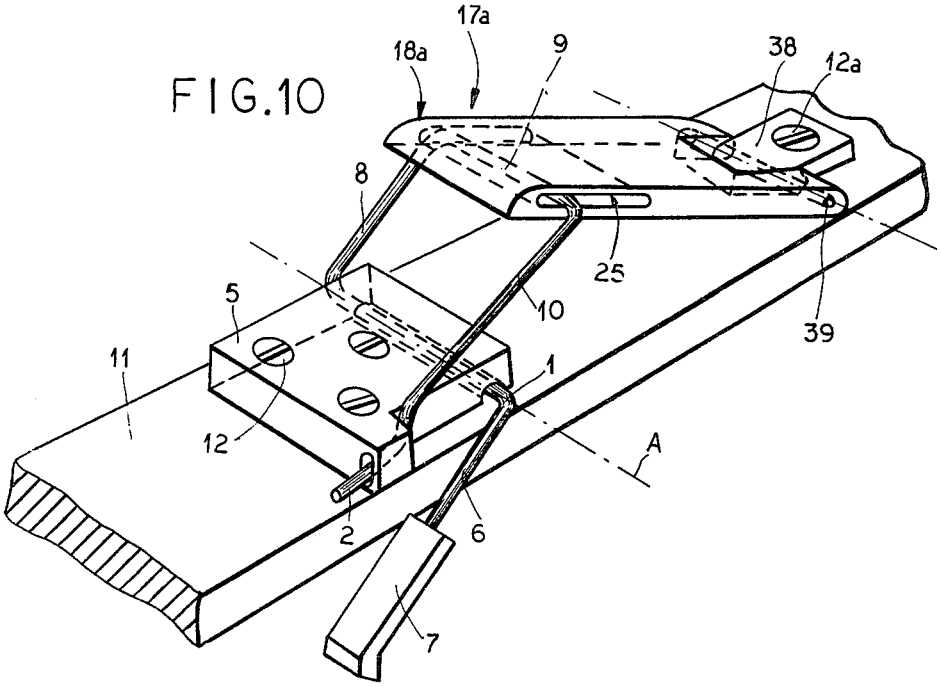
Figure 13:
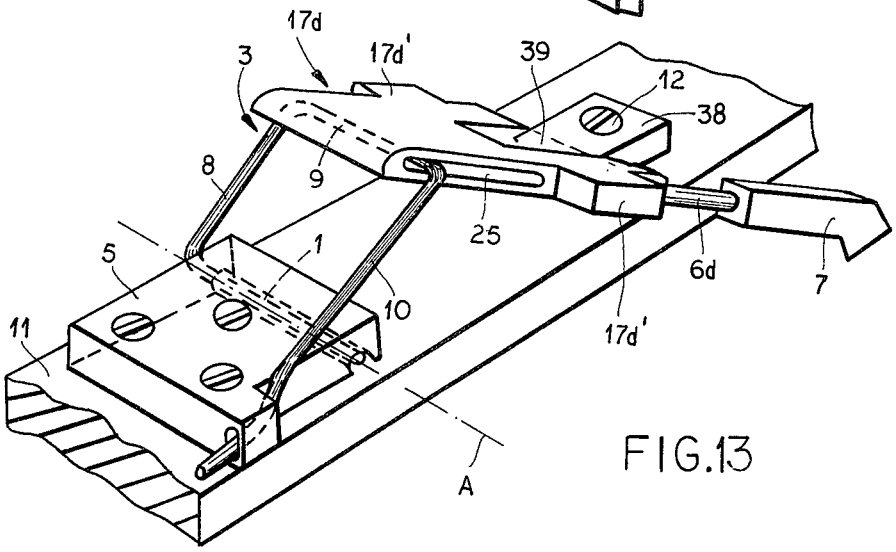

In FIG. 13 a pedal 17*c* is provided which is substantially identical to the pedal 17*a* of FIG. 10, except that it has a pair of lateral projections 17*d'* from each of which extends a pin 6*d* carrying a respective brake bar element 7. Thus the loop 3 in this arrangement has a purely biasing function.

Finally in FIG. 14 a system is provided which is identical to that of FIG. 9, except that a wire loop 3*e* is provided which is continuously curved between its sections 1 and 2. Once again this loop 3*e* is directly contacted by the skiboot during use.

I claim:

1. A ski brake comprising:

a support securable to the upper surface of a ski and forming a longitudinally elongated passage extending and opening in the normal longitudinal direction of displacement of said ski;

a brake element pivotal on said support about an element axis between a skiing position generally parallel to said ski and lying wholly above the lower surface thereof and a braking position extending downwardly past and transverse to said lower surface; and a wire biasing loop connected between said brake element and said support and urging said element into said braking position, said loop having a pivot section pivoted in said support for pivoting about a loop pivot axis generally parallel to said surfaces and perpendicular to said direction and another leg extending mainly longitudinally in said normal longitudinal direction of displacement of said ski through said passage and longitudinally displaceable therein between a forwardly advanced position corresponding to said braking position and a rearwardly retracted position corresponding to said skiing position, said loop being relatively greatly elastically deformed and lying generally in a plane parallel to said surfaces in said skiing position of said element and being less elastically deformed and standing up from said upper surface in said braking position of said element.

2. The brake defined in claim 1 wherein said wire is of spring steel.

3. The brake defined in claim 2 wherein said wire is formed as a continuous generally uniform curved loop.

4. The brake defined in claim 2 wherein said wire has a sequence of generally straight sections.

5. The brake defined in claim 1 wherein said passage has an upper side limiting displacement of said leg away from said ski, said upper side being offset longitudinally of said ski from said loop pivot axis.

6. The brake defined in claim 1 wherein said loop has an end section extending generally perpendicular to said pivot section and constituting said brake element.

7. The brake element defined in claim 6 wherein said brake element includes a synthetic-resin bar molded on and covering said end section.

8. The brake defined in claim 1 wherein said loop has a bight connecting said pivot section and said leg, said bight standing up from said upper surface in said braking position and lying generally on said upper surface in said skiing positions.

9. The brake defined in claim 8, further comprising a pedal pivoted on said support and connected to said bight, said pedal standing up from said upper surface in said braking position and lying generally on said upper surface in said skiing position.

10. The brake defined in claim 9 wherein said pedal has an end pivoted on said support and another end connected to said bight, said other end having an upwardly curved and convex edge region engageable with a skiboot.

11. The brake defined in claim 10 wherein the pivoted end of said pedal lies relative to the normal displacement direction of said ski ahead of the other end of said pedal.

12. The brake defined in claim 10 wherein the pivoted end of said pedal lies relative to the normal displacement direction of said ski behind the other end of said pedal.

13. The brake defined in claim 12 wherein said brake element is fixed on and generally parallel to said pedal.

14. A ski brake comprising:

a support securable to the upper surface of a ski and forming a longitudinal passage extending in the normal direction of displacement of said ski;

a brake element pivotal on said support about an element axis between a skiing position generally parallel to said ski and lying wholly above the lower surface thereof and a braking position extending downwardly past and transverse to said lower surface;

a wire biasing loop connected between said brake element and said support and urging said element into said braking position, said loop having a pivot section pivoted in said support for pivoting about a loop pivot axis generally parallel to said surfaces and perpendicular to said direction and another leg extending through said passage and longitudinally displaceable therein between a forwardly advanced position corresponding to said braking position and a rearwardly retracted position corresponding to said skiing position, said loop being relatively greatly elastically deformed and lying generally in a plane parallel to said surfaces in said skiing position of said element and being less elastically deformed and standing up from said upper surface in said braking position of said element, said loop having a bight connecting said pivot section and said leg, said bight standing up from said upper surface in said braking position and lying generally on said upper surface in said skiing position; and a pedal pivoted on said support and connected to said bight, sid pedal standing up from said upper surface in said braking position and lying generally on said upper surface in said skiing position, said pedal having an underside turned toward said ski and lying generally thereon in said skiing position, said underside being generally of V-shape and having a central ridge engaging said upper surface in said skiing position and a pair of flanking surface regions extending upwardly from said ridge away from said upper surface.

15. The brake defined in claim 1 wherein said support is a mounting plate formed with a transverse passage extending along said loop pivot axis and rotatably receiving said pivot section and with said longitudinal passage.

16. The brake defined in claim 15 wherein said plate has a lateral extension forming said longitudinal passage.

17. The brake defined in claim 15 wherein said passage is generally of hyperboloidal shape and is flared longitudinally in both directions.

18. The brake defined in claim 15 wherein said longitudinal passage has an upper side formed by said plate and downwardly convex and a lower side formed by said upper surface of said ski.

19. The brake defined in claim 1 wherein said leg is formed with an elbow, said passage having an upper side fitting into said elbow in said braking position of said element.

20. The brake defined in claim 19 wherein said loop except for said leg lies mainly relative to the normal direction of displacement of said ski ahead of said pivot axis in the skiing and braking positions and said leg extends backwardly from said loop past said pivot axis, said longitudinal passage being behind said pivot axis.

21. The brake defined in claim 1 wherein said leg has a tip engaging forwardly and downwardly with said ski in said braking position, said loop except for said leg lying relative to the normal direction of displacement of said ski behind said pivot axis in said skiing and braking position and said leg extending forwardly from said loop past said pivot axis, said longitudinal passage being ahead of said pivot axis and behind said tip.

22. The brake defined in claim 1, further comprising a second such element and loop, both of said pivot axes being coaxial, said elements being generally parallel.

23. The brake defined in claim 1 wherein said loop has two relatively parallel sections and another section transverse to and bridging said parallel sections.

24. The brake defined in claim 1 wherein said leg has an extension constituting said brake element.

25. The brake defined in claim 1, further comprising an abutment on said ski engaging in said braking position behind said leg relative to the normal direction of travel of said ski.

* * * * *